US007381877B2

(12) United States Patent
Shigenaga

(10) Patent No.: US 7,381,877 B2
(45) Date of Patent: Jun. 3, 2008

(54) FOOT PEDAL FOR DRUM

(75) Inventor: Fumihiro Shigenaga, Hamamatsu (JP)

(73) Assignee: Yamaha Corporation, Shizuoka (JP)

( * ) Notice: Subject to any disclaimer, the term of this patent is extended or adjusted under 35 U.S.C. 154(b) by 0 days.

(21) Appl. No.: 11/446,770

(22) Filed: Jun. 5, 2006

(65) Prior Publication Data

US 2006/0278060 A1 Dec. 14, 2006

(30) Foreign Application Priority Data

Jun. 8, 2005 (JP) ..... 2005-167913

(51) Int. Cl.
*G10D 13/02* (2006.01)

(52) U.S. Cl. ..... 84/422.1

(58) Field of Classification Search ..... 84/411.2, 84/422.1, 422.2, 422.3
See application file for complete search history.

(56) References Cited

U.S. PATENT DOCUMENTS

| | | | | |
|---|---|---|---|---|
| 3,722,349 | A | 3/1973 | Hoellerich | |
| 5,185,489 | A * | 2/1993 | Hoshino | 84/422.1 |
| 5,726,340 | A * | 3/1998 | Takagi et al. | 558/274 |
| 5,726,370 | A * | 3/1998 | Yanagisawa | 84/422.1 |
| 6,011,208 | A * | 1/2000 | Hoshino | 84/422.1 |
| 6,596,934 | B2 | 7/2003 | Hsieh | |

FOREIGN PATENT DOCUMENTS

| | | |
|---|---|---|
| DE | 40 20 794 | 1/1991 |
| DE | 197 20 375 | 11/1997 |
| EP | 1 341 152 | 9/2003 |
| JP | 52-119817 | 9/1977 |
| JP | 57-93990 | 6/1982 |
| JP | 63-120299 | 8/1988 |
| JP | 05-073032 | 3/1993 |
| JP | 08-248949 | 9/1996 |
| JP | 11-184461 | 7/1999 |

* cited by examiner

*Primary Examiner*—Kimberly Lockett
(74) *Attorney, Agent, or Firm*—William L. Androlia; H. Henry Koda

(57) ABSTRACT

The present invention provides a foot pedal for a drum that can clamp a hoop regardless of a board thickness of a hoop, improves an operability, handling and moreover, appearance, and increases a freedom of a setting the angle of a foot board. A pedal frame provides a hoop pushing apparatus that clamps a drum hoop. The hoop pushing apparatus includes: a hoop clamp with rotatability; a bolt that is provided at a front edge portion of the hoop clamp, piercing the hoop clamp, and can be adjusted in height; a hoop holding and binding lever that is provided at a bottom side of the hoop clamp with rotability; and a clamp holding mechanism that rotates and holds the hoop clamp at a certain height. The hoop pushing apparatus, upon clamping, holds and binds the hoop with a hoop receiving member and the hoop holding and binding lever.

3 Claims, 7 Drawing Sheets

FOOT PEDAL FOR DRUM

BACKGROUND OF THE INVENTION

1. Field of the Invention

The present invention relates to a foot pedal for a drum for beating a drumhead on a bass drum by using the foot.

Priority is claimed on Japanese Patent Application No. 2005-167913, filed Jun. 8, 2005, the content of which is incorporated herein by reference.

2. Description of the Related Art

This kind of foot pedal used for playing the bass drums has a hoop clamping apparatus for clamping a hoop (a frame for clamping) (for example, see Japanese Patent Application, First Publication No. H11-184461, Japanese Patent Application, First Publication No. H05-73032 and Japanese Patent Application, First Publication No. H08-248949).

FIG. 3 and FIG. 4A-C show an example of a foot pedal for a drum in a prior art. A foot pedal 1 of the drum has a hoop clamping apparatus 4 clamping a hoop (clamping frame) 3 of a drum 2, and upon stepping on a footboard 5, a leg-power transmission member 6 is pulled down and a rocker 7 is rotated to a direction of a bass drum 2, therefore, a beater 9 attached to an end of a beater rod 8 beats a drumhead 10.

The hoop clamping apparatus 4 includes a hoop clamp 13 provided with rotatability on a supporting bar base 12 of a pedal frame 11, an adjuster bolt 14 attached at a back end side of this hoop clamp 13 (side of a player), a cam mechanism 15 rotating the hoop clamp 13 when the hoop 3 is clamped, and so on. The cam mechanism 15 has a cam 17 rotating the hoop clamp 13 and a clamp lever 18 rotating this cam 17. The cam 17 is formed to be substantially rectangular upon viewing from a side or to be oval (elliptical) and is set to the supporting bar base 12 via a rotation shaft 16 so as to be just under the adjuster bolt 14. The cam 17 is formed to have an external surface that is a cam-shaped surface, it is kept in a substantially horizontal state as shown in FIG. 4A when the hoop 3 is not clamped, and its upper surface touches an under surface of the adjuster bolt 14. The clamp lever 18 is attached to one edge of the rotation shaft 16.

When the hoop 3 is clamped by using the hoop clamping apparatus 4, a height of the adjuster bolt 14 should be adjusted corresponding to a board thickness of the hoop 3 beforehand, and a gap between a hoop receiving portion 12A of the supporting bar base 12 and the hoop clamp 13 should be larger than the board thickness of the hoop 3. Next, the hoop 3 is inserted into the gap between the hoop receiving portion 12A and the hoop clamp 13, and a bottom of the hoop 3 is mounted on the hoop receiving portion 12A. In this state, as shown in FIG. 4B or 4C, the clamp lever 18 is rotated substantially 90 degrees clockwise, and the cam 17 is raised perpendicularly. When the cam 17 stands up, the adjuster bolt 14 is pushed up, and the hoop clamp 13 pushes the hoop 3 by rotating in a counterclockwise direction around an axis 19 as a center of the rotation, therefore, the hoop 3 is held by binding with both the hoop receiving portion 12A and the hoop clamp 13. In FIG. 3, a symbol 20 is a rotation axis (shaft) laying across laterally and rotatably between a pair of bars 21 set right and left of the pedal frame 11, and a symbol 22 is an extension spring giving a constant rotational force to the footboard 5 and the beater 9 via the rocker 7 in a direction of returning. FIG. 4B is a figure showing a state in which a hoop with a large board thickness is held by binding, and FIG. 4C is a figure showing a state in which a hoop with a small board thickness is held by binding.

A setting angle $\alpha$ (height) of the footboard 5 of the foot pedal 1 for such a drum is varied in accordance with a preference of a player, and it is possible to adjust it by changing a length of the leg-power transmission member 6. In this case, a moving distance (rotation angle) of the beater 9 to the drumhead 10 upon stepping on the footboard 5 is kept constant, therefore, a moving distance (falling distance) of the footboard 5 is also constant regardless of the setting angle $\alpha$.

In accordance with the conventional hoop pushing apparatus 4 above, the adjuster bolt 14 is attached at a rear edge side of the hoop clamp 13, therefore, in a case such that a setting angle $\alpha$ is small, when the footboard 5 is stepped on, there is a possibility that the footboard 5 may hit the adjuster bolt 14 or the hoop clamp 13, and therefore, there is a problem in that an adjustment range of the setting angle $\alpha$ is limited.

Moreover, the adjuster bolt 14 is set at a position under the footboard 5, therefore, a hand should be inserted under the footboard 5 and the adjuster bolt 14 should be rotated (screwed, or wrenched) upon adjusting it, that is, there is a problem in that an adjusting operation is troublesome.

On the other hand, for example, foot pedals for the drum shown in Japanese Patent Application, First Publication No. H05-73032 and Japanese Patent Application, First Publication No. H08-248949 are known.

With respect to the foot pedal for the drum described in Japanese Patent Application, First Publication No. H05-73032, it is constituted from a connection portion that connects the hoop of the bass drum to the pedal frame and that includes two members, an upper portion and a lower portion, formed in a shape like an alligator's mouth. These two members are supported by a shaft and can be opened and closed. These two members are pierced and screwed together by a wing nut. Therefore, upon clamping the hoop, it is possible to hold and bind the hoop by the two members in the shape like an alligator's mouth by clamping the wing nut. However, in accordance with such a structure, the hoop should be clamped by using a clamping force in order to clamp the hoop, therefore, it is difficult to clamp the hoop with a large holding or binding force, and therefore, there is a problem in that the hoop is easily disengaged from the two members in the shape like an alligator's mouth because of vibrations and the like upon playing.

The foot pedal for the drum described in Japanese Patent Application, First Publication No. H08-248949 includes a cam member for rotating a hoop clamp body and a hoop clamp operation unit constituted from an adjuster bolt with a handle for rotating the cam member, which are on a base plate providing a front frame and their side of the adjuster bolt with the handle is protruding outward from an outer edge of the footboard while they are in a shape extended with an oblique angle in a direction from a front edge portion of the cam member to a side of the bolt with the handle. In accordance with such a structure, because the adjuster bolt is provided at a right or left side from the foot board, therefore, there is no interference between the footboard and the adjuster bolt even when the setting angle is small. Moreover, there is an advantage in that it is possible to clamp and release the hoop by operating at a right or left side of the foot pedal with good operability without being disturbed from the drumhead of the bass drum.

However, in a case of providing the hoop clamp operation unit protruding at the right or left side of the foot board, a larger setting space is needed for the foot pedal for the drum upon using, therefore, there is a problem in that settings of other drums or stands for music instruments are limited. In a case of providing the hoop clamp operation unit protruding at the right or left side of the foot board, there are problems such that it has a poor appearance and a larger space for storing is needed.

SUMMARY OF THE INVENTION

The present invention was devised in order to address the above-described problems, and has as an object of providing a foot pedal for a drum that can clamp the hoop reliably regardless of the board thickness of the hoop, that improves operability and a handling along with providing a good appearance, and that extends a freedom of a setting angle of the foot board.

In order to attain the objects above, the present invention provides a foot pedal for a drum, including: a hoop clamp that is provided on a supporting bar base of a pedal frame with a rotatability in a direction back and forth; a hoop of a bass drum that is provided at a front edge portion of the hoop clamp and is adjusted with respect to a height; a hoop pushing unit that pushes and fixes the hoop on a hoop receiving portion of the supporting bar base; and a clamp holding unit that rotates and holds the hoop clamp upon clamping the hoop.

In the above-described foot pedal for the drum, the hoop pushing unit may be a bolt that is screwed and set into a screw hole which is formed at a front edge portion of the hoop clamp.

In the above-described foot pedal for the drum, the clamp holding unit may include: a cam that is provided at the supporting bar base with rotatability and has a cam surface touching a bottom of a rear edge potion of the hoop clamp; and a clamp lever that rotates the cam.

The above-described foot pedal for the drum, may further includes: a hoop holding and binding lever that is provided at a bottom side of a front edge portion of the hoop clamp, has a rotatability upward and downward, and is pushed to the hoop by the hoop pushing unit; and an energizing unit that gives a force in a returning direction to the hoop holding and binding lever.

In accordance with the present invention, the hoop pushing unit is provided and its height can be adjusted, therefore, it is easy to adjust the height of the hoop pushing unit and it improves operability and handling of the foot pedal. There is no possibility that a footboard hits the hoop pushing unit, therefore, it is possible to apply the setting angle of the foot pedal smaller and to extend the range of the setting angle.

Moreover, the hoop clamp operation unit is provided such that it is not protruding at the right or left side of the foot board, therefore, its appearance is not harmed and space for storing can be smaller.

In accordance with the present invention, by applying the clamp holding unit, the hoop clamp is rotated upon clamping, the setting angle is not changed because of the board thickness of the hoop and it is possible to improve the freedom of changing of the setting angle of the foot board.

In accordance with an aspect of the present invention, the hoop clamp pushing unit is constructed from a bolt, therefore, products on a general market can be applied.

In accordance with an aspect of the present invention, the hoop clamp is provided with rotatability in backward and forward directions around a rotation shaft which is a fulcrum, therefore, it is possible to provide a large external force at a front edge portion by applying a leverage. Moreover, the clamp holding unit is constituted from the cam provided under a rear edge portion of the hoop clamp with rotatability and the clamp lever that rotates the cam, therefore, a larger external force can be provided on the hoop clamp.

In accordance with still another aspect of the present invention, the hoop holding and binding lever is further included, therefore, compared to a hoop pushing means constructed from a bolt, it is possible to extend a contact area and to clamp the hoop stably and reliably.

DETAILED DESCRIPTION OF THE INVENTION

Hereafter, the present invention is explained in detail based on an embodiment referring to figures.

Figure 1:
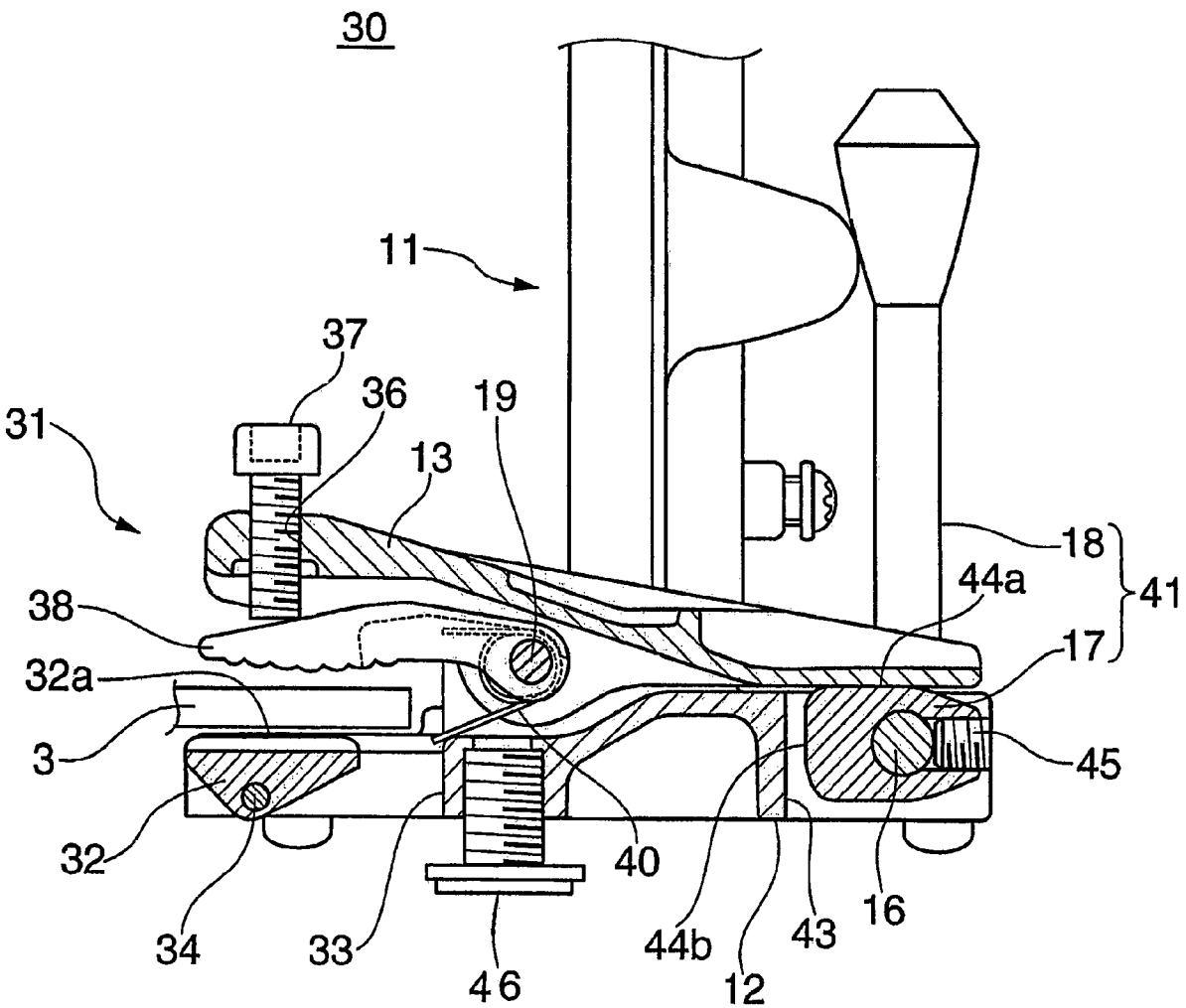
FIG. 1 is a cross-sectional view showing a principal part of a foot pedal for a drum according to an embodiment of the present invention when not clamped.
Figure 2A:
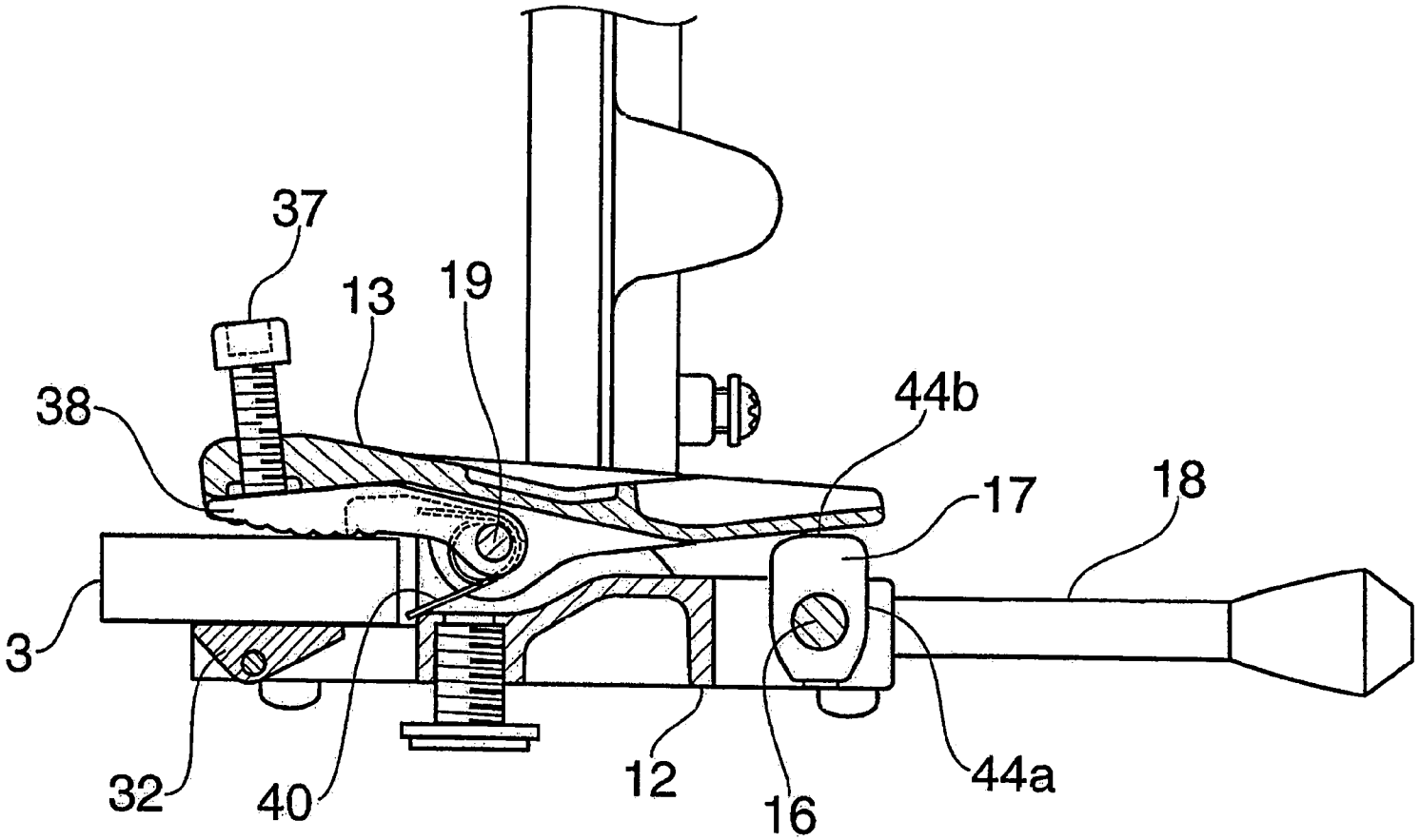
FIG. 2A is a cross-sectional view showing the embodiment of the present invention in a state upon clamping a hoop with a large board thickness.
Figure 2B:
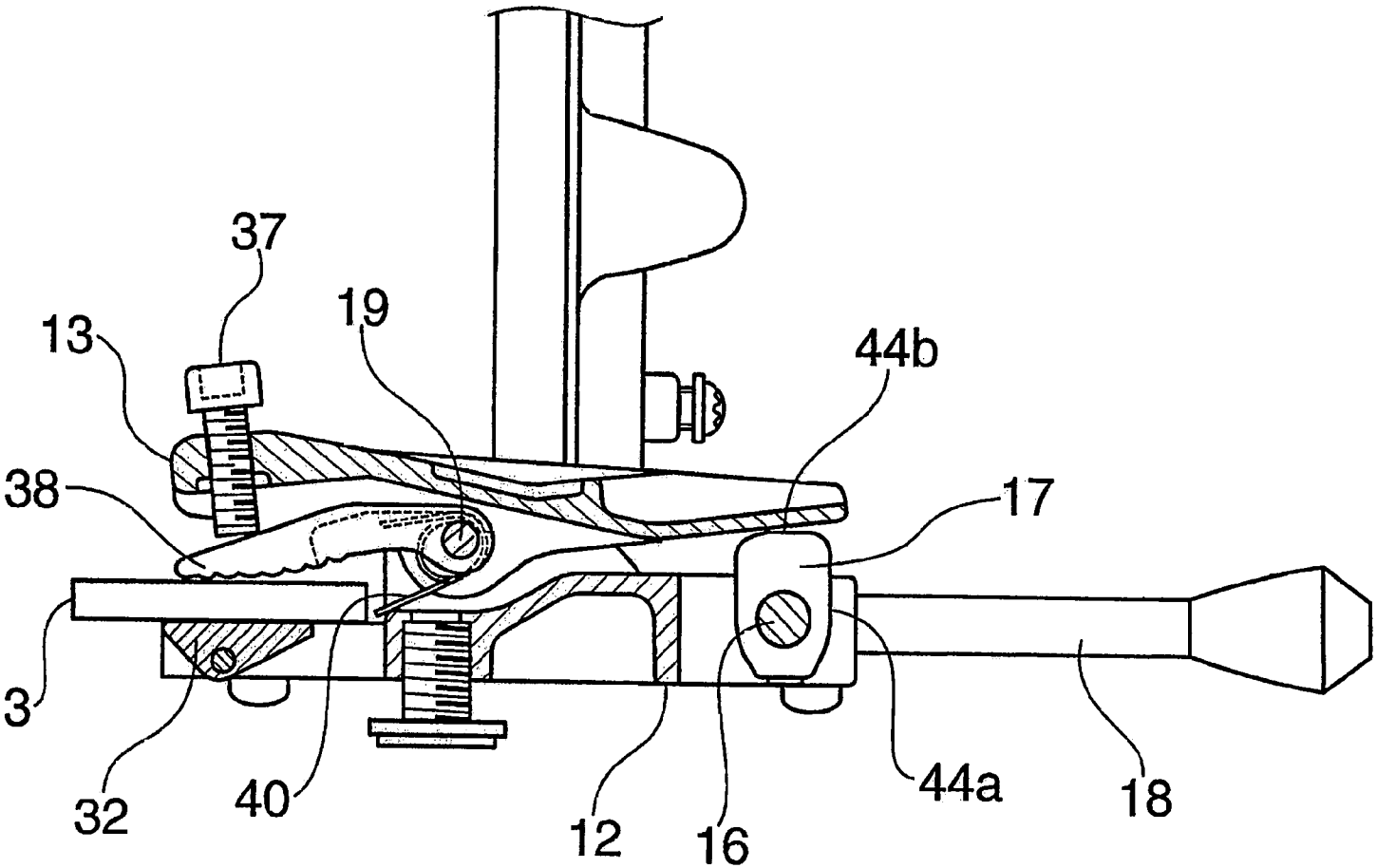
FIG. 2B is a cross-sectional view showing the embodiment of the present invention in a state upon clamping a hoop with a small board thickness.

FIG. 1 shows a principal part of a foot pedal for a drum of the present invention when not clamped, and FIGS. 2A and 2B show states upon clamping hoops with a large board thickness and a small board thickness. It should be noted that the same portions and/or parts are referred by using the same symbols (reference numerals) for a foot pedal of the prior art shown in FIGS. 3 and 4.

Figure 3:
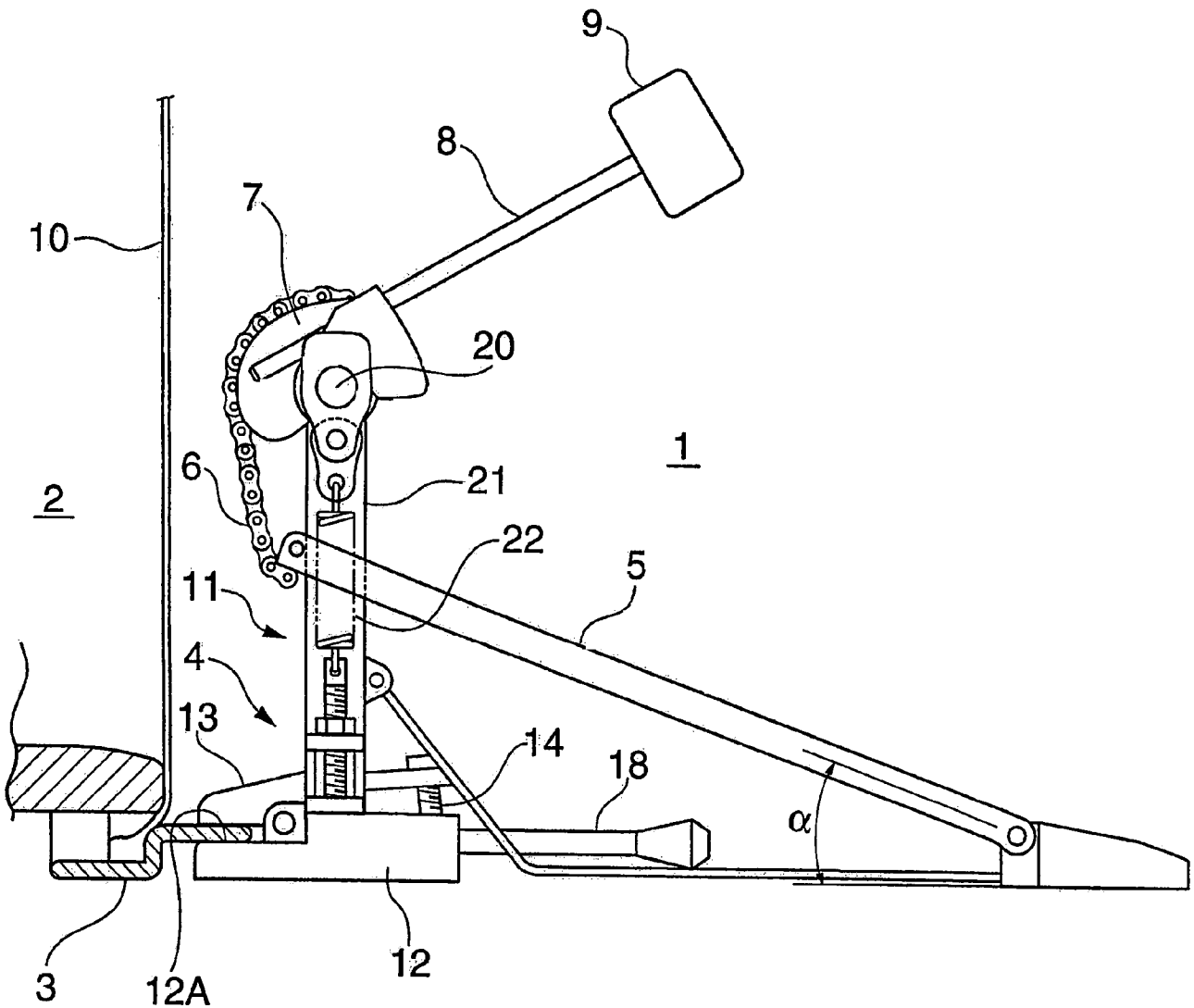
FIG. 3 is a cross-sectional view showing a conventional foot pedal for a drum in the prior art.
Figure 4A:
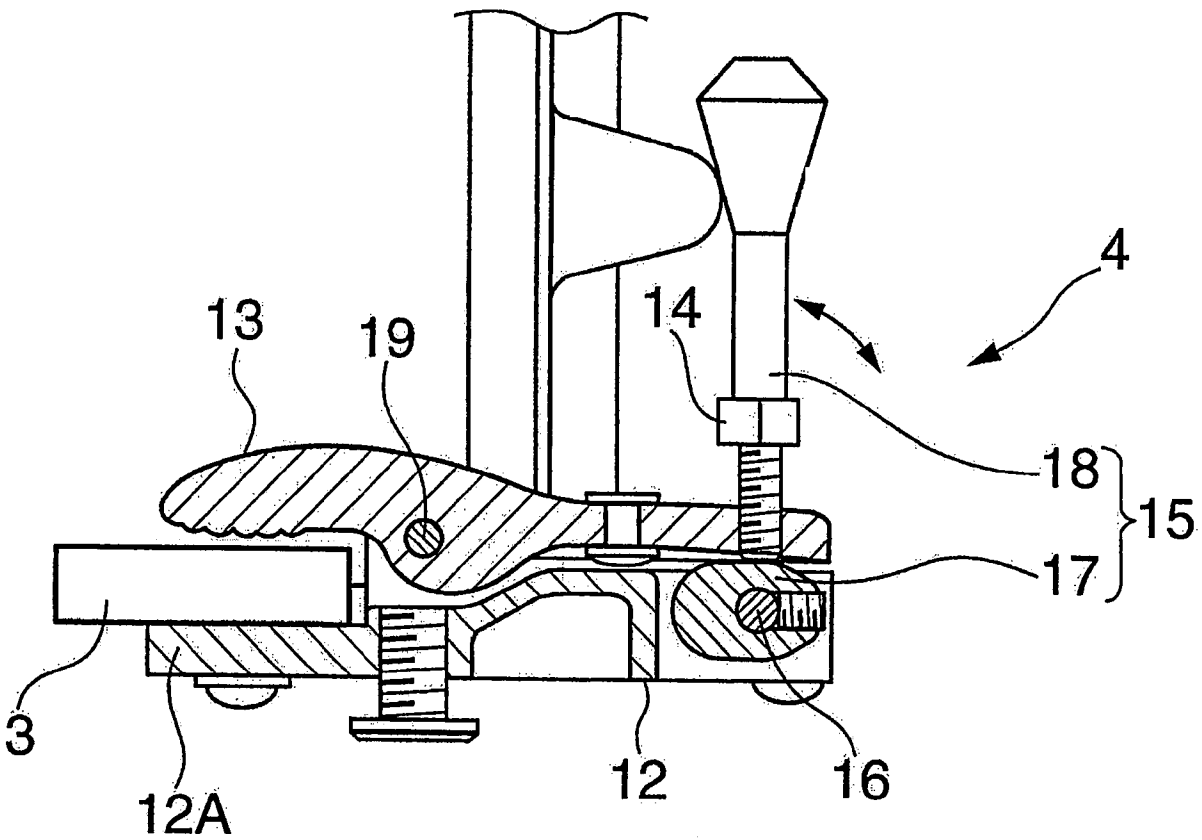
FIG. 4A is a cross-sectional view showing the conventional foot pedal when not clamped.
Figure 4B:
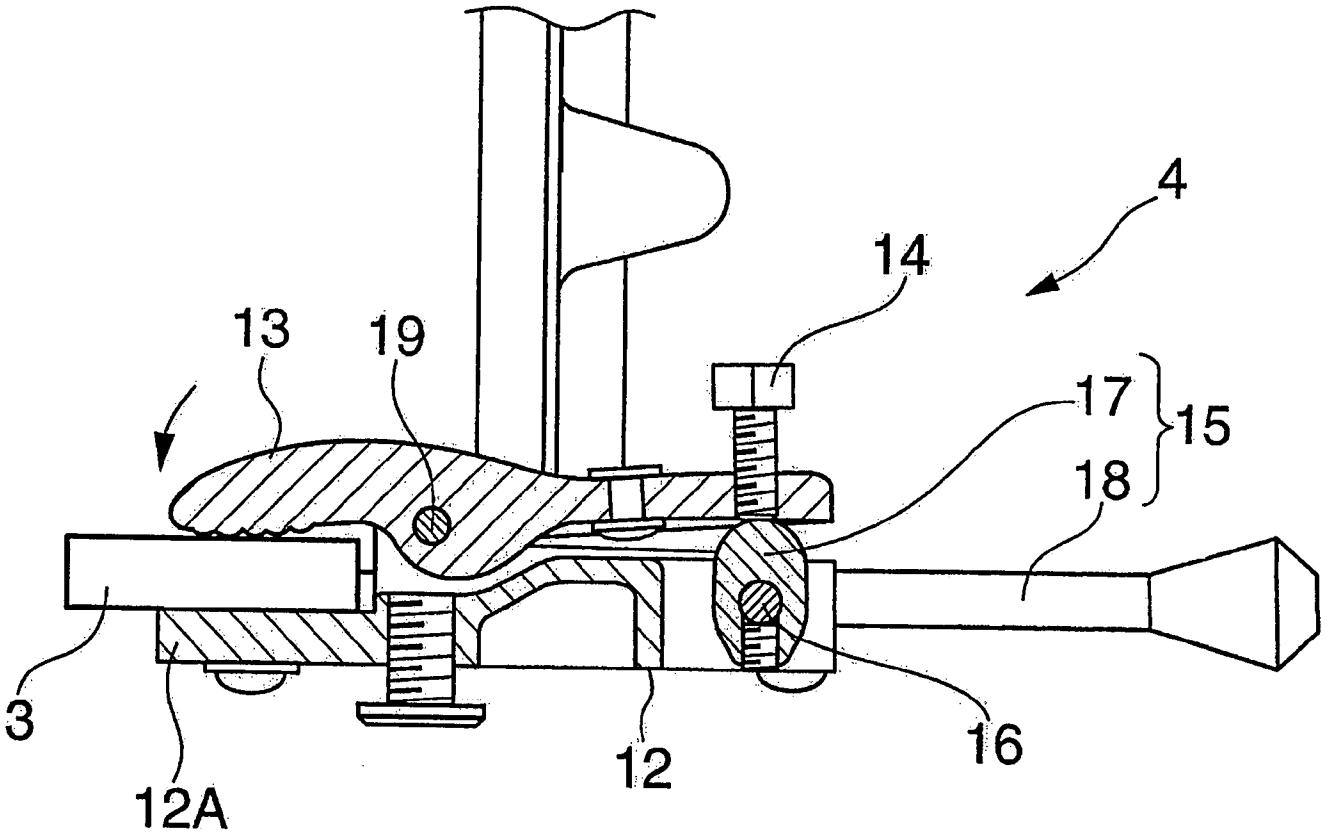
FIG. 4B is a cross-sectional view showing of the conventional foot pedal in a state upon clamping a hoop with a large board thickness.
Figure 4C:
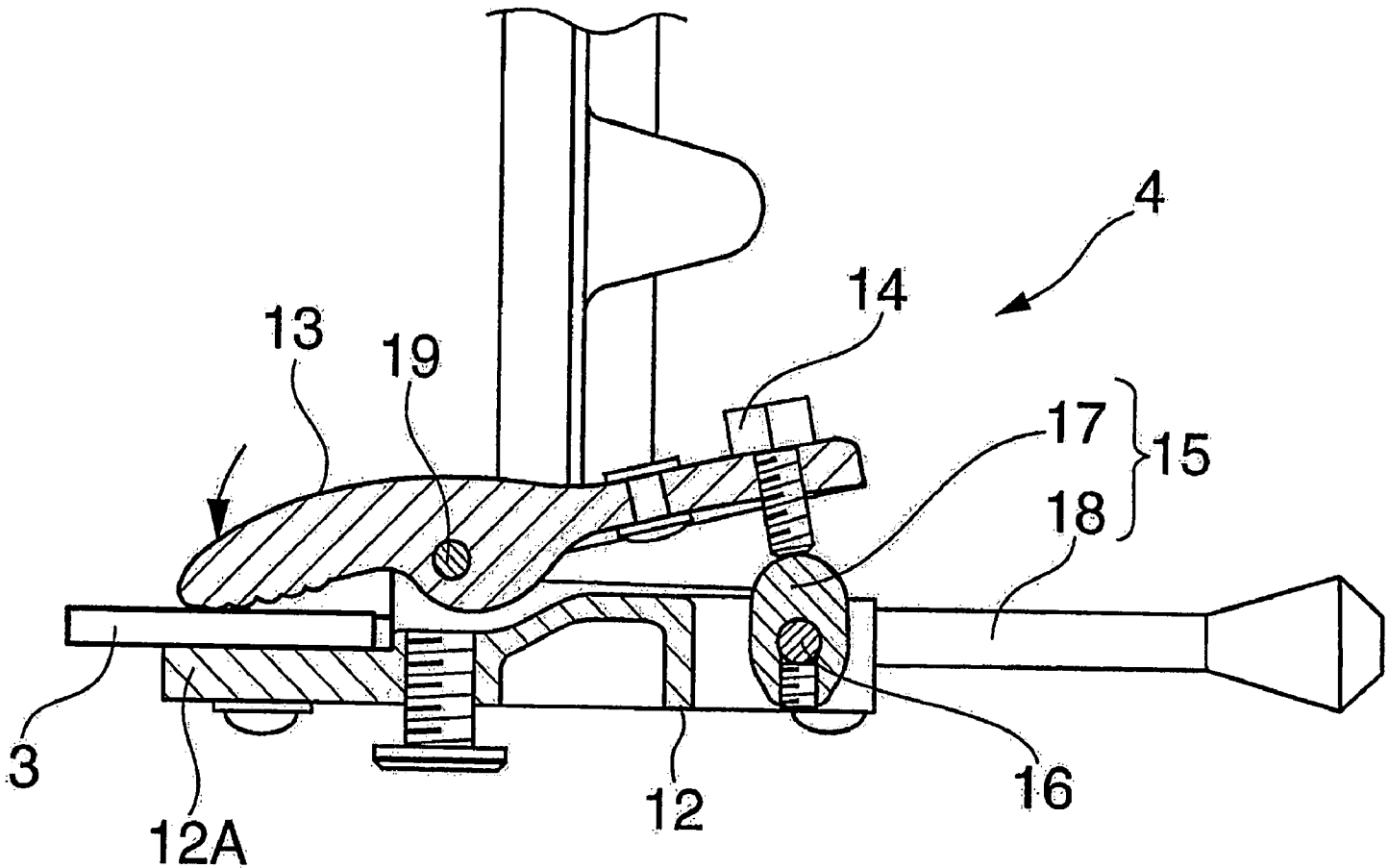
FIG. 4C is a cross-sectional view showing of the conventional foot pedal in a state upon clamping a hoop with a small board thickness.

In FIGS. 1 and 2, a foot pedal 30 of a drum of the present invention, as with the foot pedal for the drum of the prior art shown in FIG. 3, includes a pedal frame 11 in a square shape upon viewing from the front, a footboard 5 stepped on by a player with his/her foot, a beater 9 (see FIG. 3) which beats a drum head 10 and the like. However, there is a difference in a hoop clamping apparatus 31 provided at a supporting bar base 12 of the pedal frame 11 and clamping a hoop 3 of a bass drum 2, from a hoop clamping apparatus 4 in FIGS. 3 and 4.

The hoop clamping apparatus 31 has a hoop receiving member 32 provided at the supporting bar base 12 for receiving the hoop and a hoop clamp 13 provided upward from the supporting bar base 12.

The hoop receiving member 32 is formed in a inverted triangle shape upon being seen from a side, is set inside a slit (concave, depression or the like) portion 33 formed at a front edge of the supporting bar base 12 by horizontally providing a shaft 34 while being supported with rotatablility in a direction back and forth (in a direction up and down), and has the hoop 3 set on a upper surface 32*a*. With respect to the shaft 34, both edges are supported with rotatability by bearing apertures provided at both right and left side walls of the slit portion 33, and the shaft 34 pierces an aperture (through-hole) provided at a center between a head and a tail and at slightly closer to a bottom of the hoop receiving member 32.

The hoop clamp 13 has the same length as or longer than a length substantially from a head to a tail (horizontal length in figures) of the supporting bar base 12 and has an appropriate width. The hoop clamp 13 is supported by a rotation axis 19 at the approximate center in the longitudinal direction with rotatability back and forth. The rotation axis 19 is supported with rotatability by a pair of shaft receiving portions (not shown in figures) provided at the right and left while piercing surfaces of the supporting bar base 12. A screw hole (tapped hole, screwed runner) 36 is formed at a front edge portion (on a side of the bass drum) piercing from an upper surface to a bottom. A bolt 37 constituting a hoop pressing means is screwed into and set into the screw hole 36 from the upper surface, and its lower edge appears out of the bottom of the hoop clamp 13.

At the front edge of the hoop clamp 13, on a side of the bottom, a hoop holding and binding lever 38 which holds the hoop 3 by binding it together with the hoop receiving member 32 is set. With respect to this hoop holding and binding lever 38, its front edge is set at just under the bolt 37, its rear edge is supported with rotatability in upward and downward directions by the rotation axis 19, and its front edge is touching the bottom of the bolt 37 by pushing because it is always pushed upward by an energizing means 40. A torsional coiled spring attached to the rotation axis 19 is applied to the energizing means 40, its one end is hooked to the supporting bar base 12, and another end is touching by pushing the bottom of the hoop holding and binding lever 38.

The hoop clamping apparatus 31 is provided with a clamp holding mechanism (unit) 41. This clamp holding mechanism 41 is a mechanism for keeping the hoop clamp 13 at a certain height by rotating the hoop clamp 13 upon clamping the hoop 3, and is constituted from a cam 17 for rotating the hoop clamp 13 and a clamp lever 18 for rotating the cam 17.

The cam 17 is formed in an oval (elliptical) shape seen from a side, is set inside of a slit (depression, or concave) portion 43 which has an aperture (through-hole) at a center through which a rotation shaft 16 is provided and which is formed at a rear edge of the supporting bar base 12, and is set under a rear edge of the hoop clamp 13. The cam 17 has a first cam surface 44*a* and a second cam surface 44*b* substantially crossing at right angles. The first cam surface 44*a* is a surface close to a center of the cam 17, and is set upward from the rotation shaft 16 and touching a bottom of a rear edge of the hoop clamp 13 when the hoop 3 is not clamped. On the other hand, the second cam surface 44*b* is a surface apart from the center of the cam 17, and is set at a side of the hoop 3 from the rotation shaft 16 when the hoop 3 is not clamped.

The cam 17 is fit and fixed to the rotation shaft 16 by using a setscrew 45. Both edges of the cam 17 are supported with rotatability by bearing apertures provided at both right and left side walls of the slit portion 43, and the clamp lever 18 is set at a side of one edge. As shown in FIG. 1, the clamp lever 18 is kept in a state of standing substantially up right. In this state, the hoop clamp 13 is kept so as to have a rear edge side at a lower position than a front edge side because the hoop clamp 13 is rotated clockwise by a restoring force from the hoop holding and binding lever 38 due to the energizing means 40. When the clamp lever 18 is rotated clockwise and substantially at 90 degrees from this state, the cam 17 stands up and the second cam surface 44*b* pushes up the bottom of the rear edge of the hoop clamp 13, therefore, as shown in FIG. 2B or 2C, the hoop 3 is kept in a substantially horizontal state regardless of the board thickness of the hoop 3. It should be noted that, in FIG. 1, a symbol 46 is a bolt for fixing a plate that is not shown in the figures at a bottom of the supporting bar base 12.

When the hoop 3 is clamped by using the hoop clamping apparatus 31, by adjusting a height where the bolt 37 is fixed corresponding to the board thickness of the hoop 3, a gap between the hoop receiving member 32 and the hoop holding and binding lever 38 is set to be larger than the board thickness of the hoop 3, more accurately, it is set to be substantially the same as a value obtained by adding a difference between heights of the cam surfaces 44*a* and 44*b* to the board thickness of the hoop 3. As shown in FIG. 2B or 2C, when the clamp lever 18 is rotated clockwise and substantially at 90 degrees in this state, the cam 17 stands up. When the cam 17 stands up, the second cam surface 44*b* pushes up the bottom of the rear edge of the hoop clamp 13, therefore, the hoop clamp 13 is rotated counterclockwise around the axis 19 as a center and is kept in a substantially horizontal state. When the hoop clamp 13 is rotated, the hoop holding and binding lever 38 is rotated in a manner such as being one unit with the hoop clamp 13 and pushes the hoop 3, therefore, the hoop 3 is held by binding between the hoop receiving member 32 and the hoop holding and binding lever 38.

As described above, with respect to the foot pedal 30 of the drum, because the bolt 37 which constitutes the hoop pushing means is attached to the front edge side of the hoop clamp 13, the footboard 5 does not hit a top portion of the bolt 37 or a rear portion of the hoop clamp 13 while the bass drum 2 is played and the footboard 5 is stepped on, therefore, it is possible to improve operativity of the foot pedal 30 of the drum upon playing.

In the present invention, in accordance with the structure, the clamp holding mechanism 41 keeps the hoop clamp 13 at a certain height regardless of the board thickness of the hoop 3, and moreover, the bolt 37 is attached at a front edge side of the hoop clamp 13, therefore, it is possible to keep and hold the hoop clamp at a lower position than the prior art. Therefore, it is possible to increase the setting angle $\alpha$ of the footboard 5.

In the present invention, the clamp holding mechanism 41 constituted from the cam 17 and the clamp lever 18 is provided, therefore, upon clamping the hoop 3, it is possible to give a large force for holding by binding to the hoop receiving member 32 and the hoop holding and binding lever 38 even though an operational force is small.

It should be noted that, in the embodiment above, the hoop holding and binding lever 38 is provided at a bottom side of a front edge of the hoop clamp 13 in order to prevent damaging to a large surface of the hoop clamp 3 upon holding and binding. Therefore, if such a mechanism is provided by the hoop pushing means 37 itself, it is possible to omit the hoop holding and binding lever 38 and to give a rotational constant force in a returning direction to the hoop 13 directly from the energizing means 40.

In the present invention, the clamp holding mechanism 41 is constituted from the cam 17 and the clamp lever 18, however, this is not a limitation and it is possible to apply various modifications.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

What is claimed is:

1. A foot pedal for a drum, comprising:

a hoop clamp provided on a supporting bar base of a pedal frame with a rotatability in a direction back and forth;

a hoop pushing unit which is provided at a front edge portion of the hoop clamp, which is adjusted with respect to a height, and which pushes and fixes the hoop of a bass drum on a hoop receiving portion of the supporting bar base; and a clamp holding unit that rotates and holds the hoop clamp upon clamping the hoop, wherein the hoop pushing unit is a bolt that is screwed into and set into a screw hole which is formed at a front edge portion of the hoop clamp.

2. The foot pedal for drum a according to claim 1, wherein the clamp holding unit comprises:

a cam provided at the supporting bar base with rotatability and having a cam surface touching a bottom of a rear edge potion of the hoop clamp; and a clamp lever that rotates the cam.

3. A foot pedal for a drum comprising:

a hoop clamp provided on a supporting bar base of a pedal frame with a rotatability in a direction back and forth;

a hoop pushing unit which is provided at a front edge portion of the hoop clamp, which is adjusted with respect to a height, and which pushes and fixes the hoop of a bass drum on a hoop receiving portion of the supporting bar base;

a clamp holding unit that rotates and holds the hoop clamp upon clamping the hoop;

a hoop holding and binding lever provided at a bottom side of a front edge portion of the hoop clamp so as to have a rotatability upward and downward, the hoop holding and binding lever being pushed to the hoop by the hoop pushing unit; and an energizing unit that gives a force in a returning direction to the hoop holding and binding lever.

* * * * *